US006851622B2

(12) United States Patent
Deméréet al.

(10) Patent No.: US 6,851,622 B2
(45) Date of Patent: Feb. 8, 2005

(54) FUEL INJECTOR HAVING A FERROMAGNETIC COIL BOBBIN

(75) Inventors: Sims B. Deméré, Newport News, VA (US); Robert McFarland, Newport News, VA (US); Dennis Bulgatz, Williamsburg, VA (US)

(73) Assignee: Siemens VDO Automotive Corporation, Auburn Hills, MI (US)

( * ) Notice: Subject to any disclaimer, the term of this patent is extended or adjusted under 35 U.S.C. 154(b) by 387 days.

(21) Appl. No.: 10/038,623

(22) Filed: Jan. 8, 2002

(65) Prior Publication Data

US 2003/0127544 A1 Jul. 10, 2003

(51) Int. Cl.[7] ..... F02D 1/06

(52) U.S. Cl. ..... 239/5; 239/585.1; 239/585.4; 239/600; 239/900; 251/129.15

(58) Field of Search ..... 239/5, 584, 585.1, 239/585.4, 585.5, 600, 900; 251/129.01, 129.15, 129.21; 335/220, 255

(56) References Cited

U.S. PATENT DOCUMENTS

| | | | | |
|---|---|---|---|---|
| 4,552,312 A | | 11/1985 | Ohno et al. | |
| 4,621,788 A | | 11/1986 | DeLew et al. | |
| 4,625,919 A | | 12/1986 | Soma et al. | |
| 4,638,973 A | | 1/1987 | Torrence | |
| 4,863,143 A | | 9/1989 | Cowley et al. | |
| 5,127,585 A | | 7/1992 | Mesenich | |
| 5,190,223 A | * | 3/1993 | Mesenich | 239/585.5 |
| 5,348,224 A | | 9/1994 | Consadori et al. | |
| 5,630,401 A | | 5/1997 | Binversie et al. | |
| 5,687,698 A | * | 11/1997 | Mastro et al. | 251/129.15 |
| 5,752,689 A | * | 5/1998 | Barkhimer et al. | 239/585.4 |
| 5,779,220 A | * | 7/1998 | Nehl et al. | 251/129.15 |
| 5,915,626 A | | 6/1999 | Awarzamani et al. | |
| 5,937,887 A | | 8/1999 | Baxter et al. | |
| 5,944,262 A | | 8/1999 | Akutagawa et al. | |
| 5,996,910 A | | 12/1999 | Takeda et al. | |
| 6,012,655 A | | 1/2000 | Maier | |
| 6,027,049 A | | 2/2000 | Stier | |
| 6,123,275 A | | 9/2000 | Geiger et al. | |
| 6,186,421 B1 | | 2/2001 | Wahba et al. | |
| 6,199,776 B1 | | 3/2001 | Andorfer | |
| 6,364,220 B2 | * | 4/2002 | Willke et al. | 239/900 |
| 6,679,435 B1 | * | 1/2004 | Noller et al. | 239/5 |

FOREIGN PATENT DOCUMENTS

| | | |
|---|---|---|
| DE | 1175 793 | 8/1964 |
| JP | 5-79423 | 3/1993 |

OTHER PUBLICATIONS

PCT/US02/40560, International Search Report, Jun. 3, 2003.

* cited by examiner

*Primary Examiner*—Steven J. Ganey

(57) ABSTRACT

A fuel injector for use with an internal combustion engine. The fuel injector can include a tube assembly, an armature assembly, a working air gap, a coil, and a housing. The tube assembly has a longitudinal axis and includes a non-magnetic tube having a first end and a second end, and a pole piece disposed inside the non-magnetic tube intermediate the first and second ends. The armature assembly is disposed within the tube assembly between the pole piece and the first end. The armature assembly includes an end face resiliently biased away from the pole piece. The working air gap separates the end face and the pole piece when the end face is biased away from the pole piece. The coil is connectable to an electrical power source and operable to displace the end face toward the pole piece against the resilient bias on the armature assembly. The housing is positioned adjacent the working air gap and supports the coil on the tube assembly. The housing extends around the coil and has a ferromagnetic inner wall extending between the coil and the non-magnetic tube. The ferromagnetic inner wall has an opening with a width that is substantially less than the length of the coil as measured parallel to the longitudinal axis.

29 Claims, 3 Drawing Sheets

FUEL INJECTOR HAVING A FERROMAGNETIC COIL BOBBIN

BACKGROUND OF THE INVENTION

It is believed that examples of known fuel injection systems use an injector to dispense a quantity of fuel that is to be combusted in an internal combustion engine. It is also believed that the quantity of fuel that is dispensed is varied in accordance with a number of engine parameters such as engine speed, engine load, engine emissions, etc.

It is believed that examples of known electronic fuel injection systems monitor at least one of the engine parameters and electrically operate the injector to dispense the fuel. It is believed that examples of known injectors use electro-magnetic coils, piezoelectric elements, or magnetostrictive materials to actuate a valve.

It is believed that such examples of the known injectors have a number of disadvantages. It is believed that examples of known injectors require a plurality of components, including numerous hermetic seals. It is also believed that examples of known injectors do not provide an optimized magnetic flux circuit.

SUMMARY OF THE INVENTION

According to the present invention, a fuel injector can include a valve assembly and a valve actuator assembly that focuses a magnetic field toward the working air gap of the valve assembly. According to one embodiment of the present invention, the valve actuator assembly can include a housing having a ferromagnetic portion adjacent the working gap. The ferromagnetic portion can extend along longitudinal axis of the fuel injector toward the working air gap. The ferromagnetic portions extend toward the working air gap from both sides of the working air gap relative to the longitudinal axis of the fuel injector.

The present invention provides a fuel injector for use with an internal combustion engine. The fuel injector can include a tube assembly, an armature assembly, a working air gap, a coil, and a housing. The tube assembly has a longitudinal axis and includes a non-magnetic tube having a first end and a second end, and a pole piece disposed inside the non-magnetic tube intermediate the first and second ends. The armature assembly is disposed within the tube assembly between the pole piece and the first end. The armature assembly includes an end face resiliently biased away from the pole piece. The working air gap separates the end face and the pole piece when the end face is biased away from the pole piece. The coil is connectable to an electrical power source and operable to displace the end face toward the pole piece against the resilient bias on the armature assembly. The housing is positioned adjacent the working air gap and supports the coil on the tube assembly. The housing extends around the coil and has a ferromagnetic inner wall extending between the coil and the non-magnetic tube. The ferromagnetic inner wall has an opening with a width that is substantially less than the length of the coil as measured parallel to the longitudinal axis.

The present invention further provides a fuel injector for use with an internal combustion engine. The fuel injector can include a thin-walled tube, a pole piece, an armature, a sleeve, a bobbin, and an electrical coil. The thin-walled tube has a first end, a second end and a longitudinal axis. The pole piece is disposed in the thin-walled tube intermediate the first and second ends. The armature is disposed within the thin-walled tube and spaced from the pole piece by a working air gap as measured in the longitudinal direction. The armature is adjustably biased away from the pole piece. The bobbin is inserted in the sleeve and has a ferromagnetic portion engaging the outer surface of the thin-walled tube on each side of the working air gap. The electrical coil is mounted on the bobbin. The electrical coil is connectable to an electrical power source and operable to displace the armature relative to the pole piece and against the bias on the armature.

The present invention also provides for a method of assembling a fuel injector. The method can include providing a tube assembly, providing an armature assembly, separating the end face and the pole piece when the end face is biased away from the pole piece to create a working air gap, providing a housing, placing a coil in the housing, positioning the non-magnetic tube ferromagnetic inner wall between the coil and the non-magnetic tube, positioning the housing adjacent the working air gap, and securing the housing to the tube assembly. The tube assembly has a longitudinal axis and includes a non-magnetic tube having a first end and a second end, and a pole piece disposed inside the non-magnetic tube intermediate the first and second ends. The armature assembly is disposed within the tube assembly between the pole piece and the first end. The armature assembly includes an end face resiliently biased away from the pole piece. The housing has a ferromagnetic inner wall having an opening with a width that is substantially less than the length of the coil as measured parallel to the longitudinal axis. The coil is connectable to an electrical power source and operable to displace the end face toward the pole piece against the resilient bias on the armature assembly.

BRIEF DESCRIPTION OF THE DRAWINGS

The accompanying drawings, which are incorporated herein and constitute part of this specification, illustrate an embodiment of the invention, and, together with the general description given above and the detailed description given below, serve to explain features of the invention.

DETAILED DESCRIPTION OF THE PREFERRED EMBODIMENT

Figure 1:
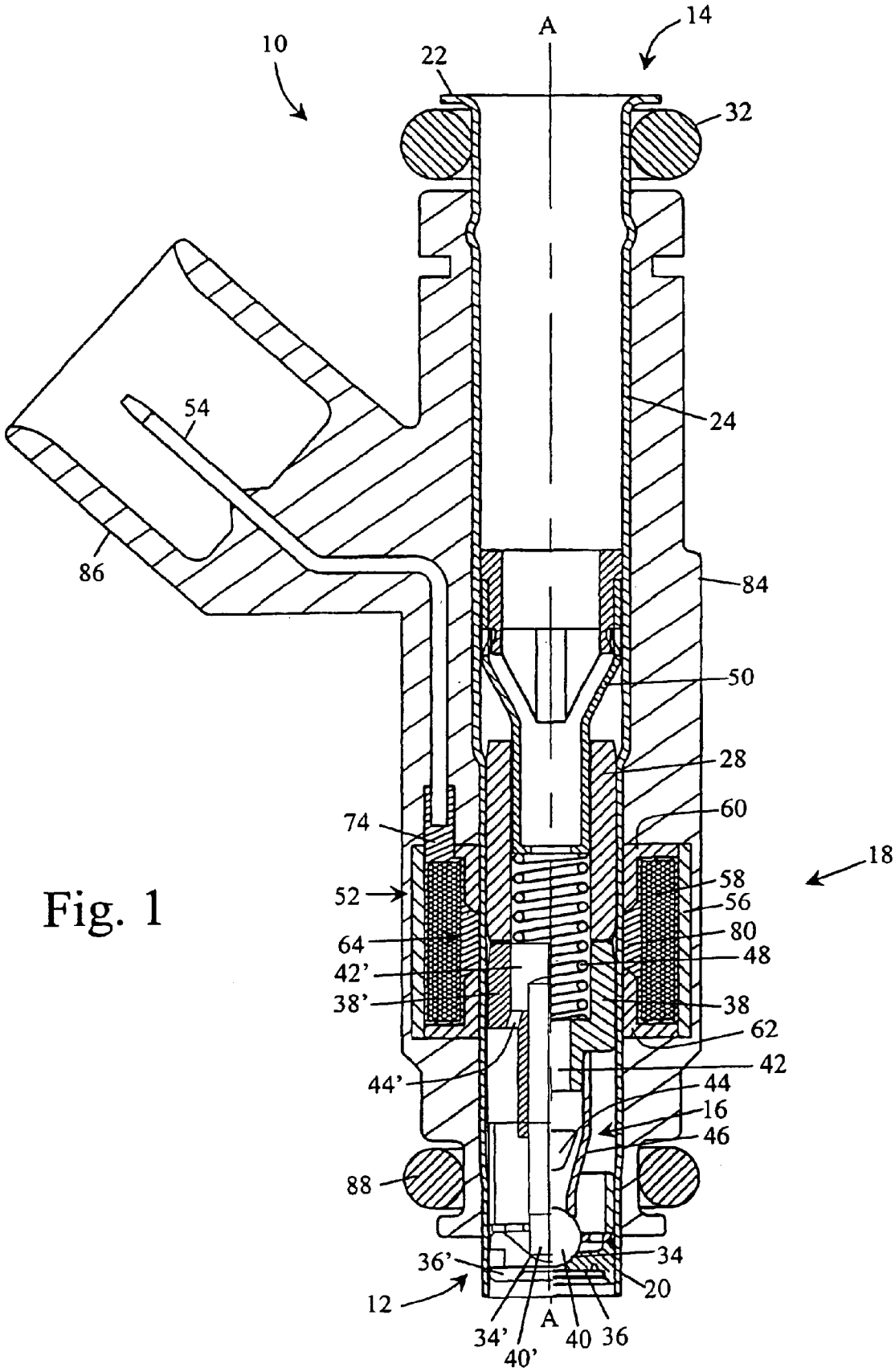
FIG. 1 is a cross-sectional view of a fuel injector according to the present invention.

Referring to FIG. 1, a solenoid actuated fuel injector 10 dispenses a quantity of fuel that is to be combusted in an internal combustion engine (not shown). The fuel injector 10 extends along a longitudinal axis A—A between a first injector end 12 and a second injector end 14, and includes a valve assembly 16 and a valve actuator assembly 18. The valve assembly 16 performs fluid handling functions, e.g., defining a fuel flow path and prohibiting fuel flow through the injector 10. The valve actuator assembly 18 performs electrical functions, e.g., converting electrical signals to a driving force for permitting fuel flow through the injector 10.

The valve assembly 16 can include a tube assembly extending along the longitudinal axis A—A between a first end 20 and a second end 22. The first and second ends 20, 22 can correspond to the first and second injector ends 12, 14. FIG. 1 illustrates two embodiments of the valve assembly, where parts common to both embodiments are designated by the same reference numeral.

The tube assembly includes at least a non-magnetic tube 24 and a pole piece 28. Preferably, the non-magnetic tube 24 extends from the first end 20 to the second end 22 of the tube assembly.

The non-magnetic tube 24 forms a thin-wall pressure vessel through which high pressure fuel flows. The thickness of the non-magnetic 24 can be optimized to withstand normal operating pressures of at least 10 bar and to simultaneously provide a minimized reluctance to magnetic flux. Other factors determining the thickness of the non-magnetic tube 24 can include vibration forces and maximum installation and removal forces. The non-magnetic tube 24 can include non-magnetic stainless steel, e.g., 300 series austenitic stainless steels, or any other suitable material demonstrating substantially equivalent structural and magnetic properties. The non-magnetic tube 24 can be formed by a deep drawing process or by a rolling operation. The pole piece 28 can include ferromagnetic material and is secured inside the non-magnetic tube 24 by a press-fit, crimping, conventional welding, friction welding, or, preferably laser welding. The pole piece 28 is located at a position intermediate the first and second ends 20, 22. The non-magnetic tube 24 can be flared at the inlet end to retain an O-ring 32.

By forming the non-magnetic tube 24 separately from the pole piece 28, different length injectors can be manufactured by using different lengths for the non-magnetic tube 24 during the assembly process. In known injectors, the length of the pole piece 28 is fixed and injector lengths preferably vary according to operating requirements. Separately forming the non-magnetic tube 24 permits modular assembly of different length non-magnetic tubes with the same size pole piece 28—and other internal components as will be explained below. This modular assembly can reduce part count, assembly complexity and manufacturing cost, among others, where a manufacturer produces multiple injector sizes to meet a range of performance and other criteria.

A seat 34, 34' is secured at the first end 20 of the tube assembly. The seat 34, 34' defines an opening centered on the fuel injector's longitudinal axis A—A and through which fuel can flow into the internal combustion engine (not shown). The seat 34, 34' includes a sealing surface surrounding the opening. The sealing surface can be frustoconical or concave in shape, and can have a finished surface. In the right half of FIG. 1, an orifice disk (not numbered) can be attached to the lower surface 36 of seat 34 by welding of other known attachment techniques. In the embodiment shown in the left half of FIG. 1, an orifice disk (not numbered) is interposed with the seat 34' and a back-up washer 36'. The orifice disks provide at least one precisely sized and oriented orifice in order to obtain a particular fuel spray pattern.

A ferromagnetic armature 38, 38' is disposed in the tube assembly. The armature 38, 38' is connected at one end to a metering member. The right half of FIG. 1 illustrates a metering member embodied as a ball valve 40. The left half of FIG. 1 illustrates the metering valve embodied as a needle valve 40'. The armature 38, 38' is disposed in the tube assembly such it confronts the pole piece 28. The metering member 40, 40' is moveable with respect to the seat 34, 34' and its sealing surface. The metering member 40, 40' is movable between a closed configuration, as shown in FIG. 1, and an open configuration (not shown). In the closed configuration, the metering member 40, 40' contiguously engages the sealing surface to prevent fluid flow through the opening. In the open configuration, the metering member 40, 40' is spaced from the seat 34, 34' to permit fluid flow through the opening.

At least one axially extending passageway 42, 42' and at least one opening 44, 44' through a wall of the armature 38, 38' can provide fuel flow through the armature 38, 38'. For the armature 38 on the right side of FIG. 1, the openings 44, which can be of any shape, are preferably non-circular, e.g., axially elongated, to facilitate the passage of gas bubbles. For example, in the case of a separate intermediate portion 46 that is formed by rolling a sheet substantially into a tube, the openings 44 can be an axially extending slit defined between non-abutting edges of the rolled sheet. Alternately, the armature 38 can be formed by a deep drawing process. The openings 44, 44' provide fluid communication to the at least one passageway 42, 42'. Thus, in the open configuration, fuel can be communicated from the passageway 42, 42', through the openings 44, 44', around the metering member 40, 40', and through the opening into the engine (not shown).

A resilient member 48 is disposed in the tube assembly and biases the armature 38, 38' toward the seat 34, 34'. An adjusting tube 50 can also be disposed in the tube assembly. The adjusting tube 50 is disposed intermediate the first and second ends 20, 22 of the tube assembly. The adjusting tube 50 engages the resilient member 48 and adjusts the biasing force of the resilient member 48 with respect to the tube assembly. In particular, the adjusting tube 50 provides a reaction member against which the resilient member 48 reacts in order to close the injector valve when the valve actuator assembly 18 is de-energized. The position of the adjusting tube 50 can be retained with respect to the non-magnetic tube 24 by an interference fit between an outer surface of the adjusting tube 50 and an inner surface of the non-magnetic tube 24. Thus, the position of the adjusting tube 50 with respect to the non-magnetic tube 24 can be used to set a predetermined dynamic characteristic of the metering member 40, 40'.

The valve assembly 16 can be assembled as follows. The pre-assembled armature 38, 38', metering member 40, 40' and intermediate portion 42, 42' can be inserted along the axis A—A from the second end 22. The pole piece 28 can then be inserted from the second end 22 along the axis A—A and positioned to provide the desired working air gap 82, as will be explained below. The pole piece 28 can be secure to the non-magnetic tube 24 by known attachment techniques such as friction welding, laser weld and, preferably, tack welding. The resilient member 48 and the adjusting tube 50 can then be inserted along the axis A—A from the second end 22. Positioning the adjusting tube 50 along the axis A—A with respect to the non-magnetic tube 24 can be used to adjust the dynamic properties of the resilient member, e.g., so as to ensure that the armature 38, 38' does not float or bounce during injection pulses. The seat 34, 34' can then be inserted from the first end 20 along the axis A—A and can be fixedly attached to the non-magnetic tube 24 by known attachment techniques such as crimping, friction welding, conventional welding and, preferably, laser welding.

Figure 2:
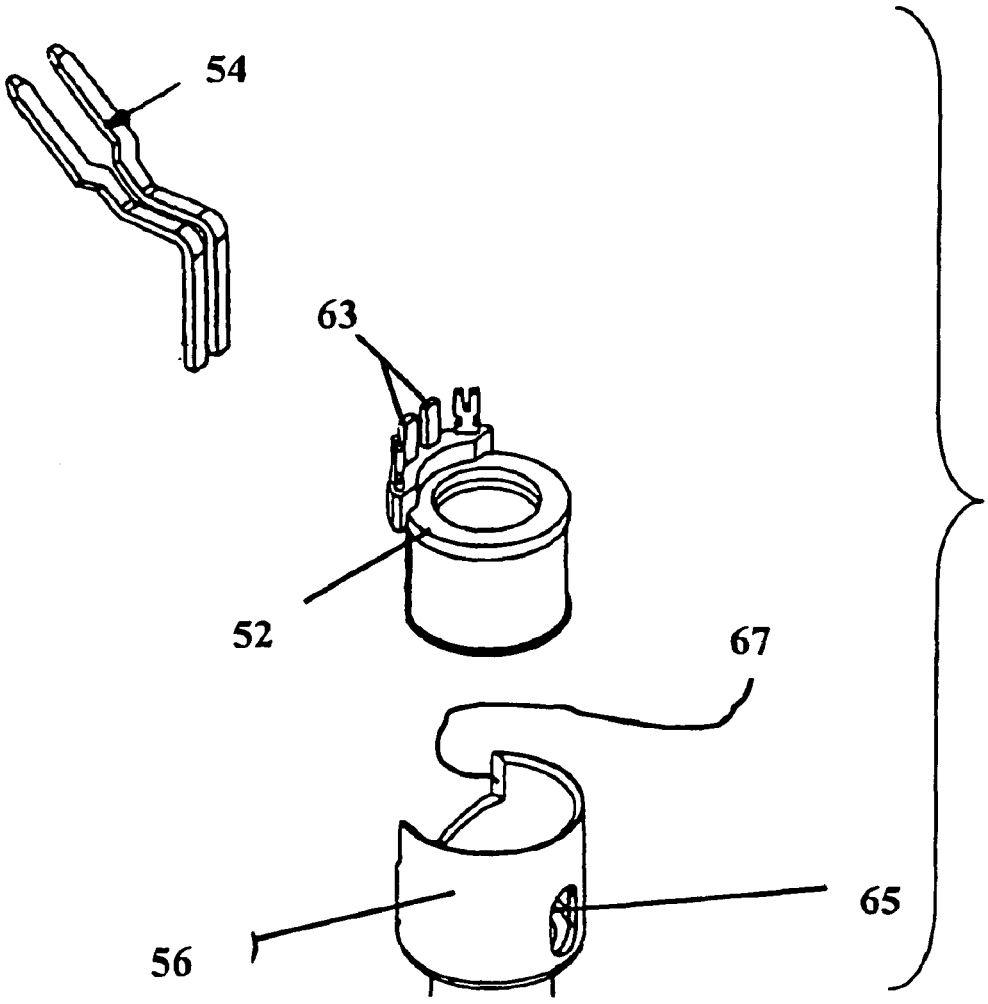
FIG. 2 is an exploded view of a portion of the fuel injector shown in FIG. 1.
Figure 3:
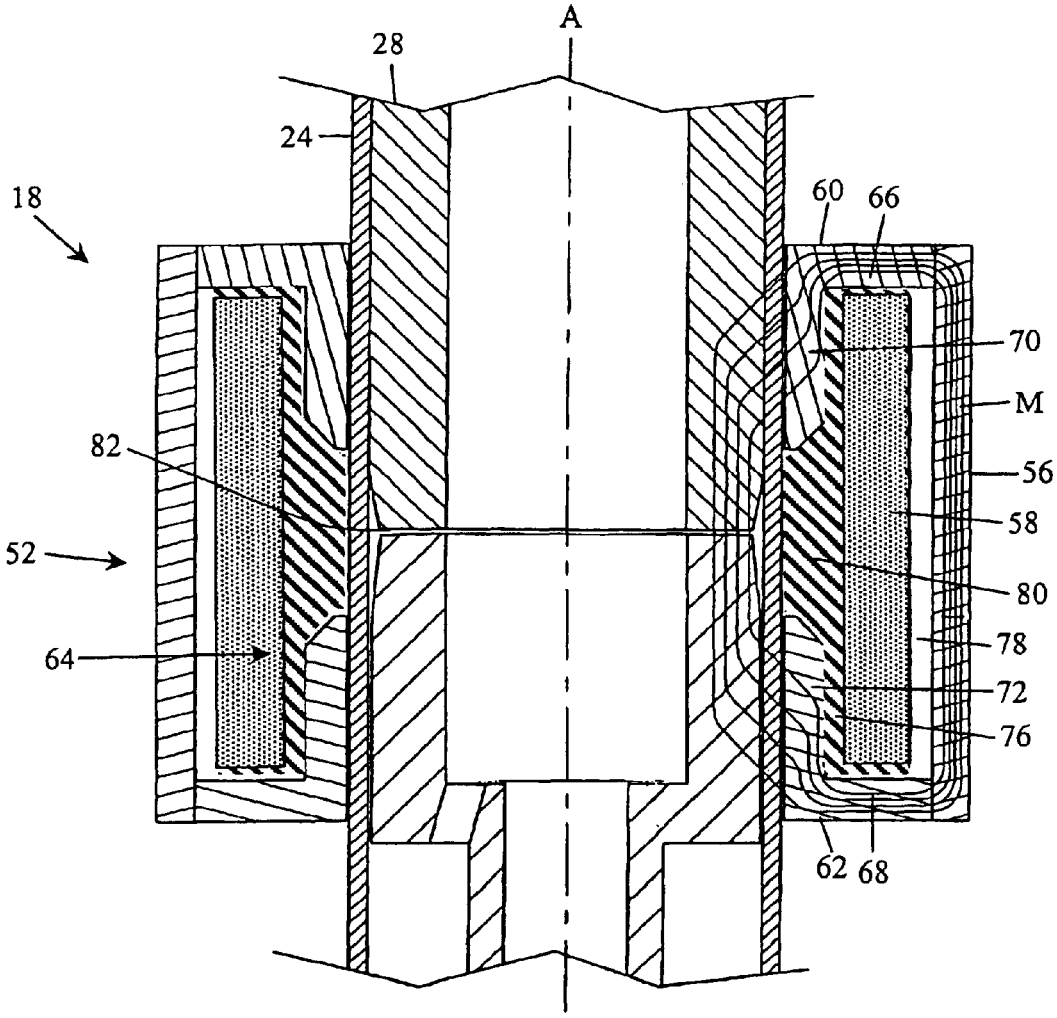
FIG. 3 is a cross-sectional view of a portion of the fuel injector shown in FIG. 1.

Referring to FIGS. 1–3, the valve actuator assembly 18 can include a bobbin 52, at least one electrical terminal 54 (FIG. 2), a housing cylinder 56 and a wire coil 58. The bobbin 52 includes a first ferromagnetic member 60, a second ferromagnetic member 62 and a plastic member 64 connecting the first and second ferromagnetic members 60, 62. The wire coil 58 is electrically connected to an electrical contact 63 (FIG. 2) supported on the bobbin 52. When energized, the wire coil 58 generates magnetic flux (schematically represented by flux lines M in FIG. 3) that moves the armature 38, 38' toward the open configuration, thereby allowing the fuel to flow through the opening.

De-energizing the wire coil 58 allows the resilient member 48 to return the armature 38, 38' to the closed configuration, thereby shutting off the fuel flow. Each electrical terminal 54 is in electrical contact with a respective electrical contact 63 of the wire coil 52. As shown in FIG. 2, the preferred embodiment includes two electrical terminals 54 and two electrical contacts 63.

FIGS. 1 and 3 illustrate the first and second ferromagnetic members 60, 62 as each including a ferromagnetic flange 66, 68 and a ferromagnetic axial extension 70, 72. The ferromagnetic flanges 66, 68 extend between the non-magnetic tube 24 and the housing cylinder 56. As shown in FIG. 3, a portion of the ferromagnetic flange 66 of the first ferromagnetic member 60 is recessed to accommodate an electrical contact support 74 for the electrical contacts 63. In the preferred embodiment, the electrical contact support 74 is integrally formed with the plastic member 64. The ferromagnetic axial extensions 70, 72 extend in the direction of the longitudinal axis A—A from the respective ferromagnetic flanges 66, 68 toward each other and are separated from each other by an opening into which the plastic member 64 extends. The opening through which the plastic member 64 extends has a length substantially less than then length of the wire coil 58; both measured along the longitudinal axis A—A. In the preferred embodiment, the first and second ferromagnetic members 60, 62 are symmetrically positioned about the wire coil 58 in the direction of the longitudinal axis A—A.

The plastic member 64 can include an inner wall 76 adjacent the non-magnetic tube 24 and outer wall 78 adjacent the housing cylinder 56. A ring 80 can be formed on inner wall to extend into the opening between the ferromagnetic axial extensions 70, 72. Alternatively, a portion of the inner wall 76 and/or the ring 80 can be formed from other non-magnetic materials, such as zinc.

In the preferred embodiment, the housing cylinder 56 connects the first and second ferromagnetic members 60, 62 at the outer ends of the ferromagnetic flanges 66, 68. Thus, the bobbin 52 provides a ferromagnetic housing containing and supporting the wire coil 58. The ferromagnetic axial extensions 70, 72 and the ring 80 of the plastic member 64 extending through the opening between the ferromagnetic axial extensions 70, 72 provide an inner wall of the ferromagnetic housing.

The ferromagnetic housing can be formed from other configurations, such as forming the ferromagnetic axial extensions 70, 72 from two housing cylinders spaced apart to form the opening and forming the ferromagnetic flanges 66, 68 on the housing cylinder 56 to extend toward the respective housing cylinder. In yet another configuration, the ferromagnetic flanges 66, 68 could be each formed by an individual disk connected between an outer housing cylinder and a respective inner housing cylinder with the outer housing cylinder extending around the ferromagnetic flanges and the two inner housing cylinders.

The housing cylinder 56, which provides a return path for the magnetic flux, generally can include a ferromagnetic cylinder surrounding the outer periphery of bobbin 52 and the wire coil 58. As shown in FIG. 2, the housing cylinder 56 can include slots, holes 65 or other features to disrupt eddy currents that can occur when the wire coil 58 is de-energized. Additionally, the housing cylinder 56 can be provided with a scalloped (or recessed) circumferential edge 67 to provide a mounting relief for the electrical contact support 74 (FIG. 1) of the bobbin 52.

The valve actuator assembly 18 can be constructed as follows. The plastic member 64 is formed by insert molding the electrical contacts 63 and the first and second ferromagnetic members 60, 62. The wire coil 58 is wound onto the plastic member 64 and terminated to the electrical contacts 63. This completes the bobbin 52. The housing cylinder 56 is then placed over the bobbin 52. The electrical terminals 54 are pre-bent to a proper configuration and then electrically connected to the respective electrical contacts 63 by brazing, soldering, welding, or preferably resistance welding. Alternatively, the electrical terminals 54 could be integrally formed with the electrical contacts 63.

The resilient member 48 normally biases the armature 38, 38' away from the pole piece 28 to separate the armature 38, 38' from the pole piece 28 by a working air gap 82. The bobbin 52 is positioned along the non-magnetic tube 24 so that the working air gap 82 lies intermediate the ends of the wire coil 58 as defined by the longitudinal axis A—A. In the preferred embodiment, the bobbin 52 is positioned along the non-magnetic tube 24 such that the working air gap 82 is centered on the wire coil 58 and between the two ferromagnetic axial extensions 70, 72 and the ring 80 is adjacent the working air gap 82.

In operation, the wire coil 58 is energized and generates magnetic flux M (FIG. 3) in the magnetic circuit. The magnetic flux moves the armature 38, 38' along the axis A—A toward the pole piece 28 to close the working air gap 82. This movement of the armature 38, 38' separates the metering member 40, 40' from the seat 34, 34', thus allowing fuel to flow (from the fuel rail, not shown) through the non-magnetic tube 24, the passageway 42, 42', the openings 44, 44', between the seat 34, 34' and the metering member 40, 40', and finally through the opening in the orifice disk (not numbered) into the internal combustion engine (not shown). When the wire coil 58 is de-energized, the armature 38, 38' is moved away from the pole piece 28 by the bias of the resilient member 48 to re-establish the working air gap 82 and to contiguously engage the metering member 40, 40' with the seat 34, 34', and thereby stop fuel flow through the injector 10.

According to a preferred embodiment, the magnetic flux M generated by the wire coil 58 flows in a circuit that can include the pole piece 28, a working air gap 82, the ferromagnetic axial extensions 70, 72, the ferromagnetic flanges 66, 68, and the housing cylinder 56. The axial extensions 70, 72 increase the area through which the magnetic flux can pass across the non-magnetic tube 24. As a result, the detrimental effect of the magnetic reluctance caused by the non-magnetic property of the non-magnetic tube 24 is minimized. Another advantage of the invention is that relative positions of the ferromagnetic axial extensions 70, 72 and the ring 80 relative to the working air gap 82 focus the magnetic flux M is focused toward the working air gap 82.

Another advantage from locating the working air gap 82 within the wire coil 58 is that the number of windings required for the wire coil 58 can be reduced. In addition to cost savings in the amount of wire that is used, less energy is required to produce the required magnetic flux M and less heat builds-up in the wire coil 58 (this heat must be dissipated to ensure consistent operation of the injector).

The completed valve assembly 16 can be inserted into the completed valve actuator assembly 18. Thus, the injector 10 could be made of two modular subassemblies that can be assembled and tested separately, and then connected together to form the injector 10. The valve assembly 16 and the valve actuator assembly 18 can be fixedly attached by adhesives, welding, or another equivalent attachment process.

The valve actuator assembly 18 is positioned external to the fluid path through the non-magnetic tube 24 to provide a dry valve actuator assembly. Therefore, no hermetic seals are required between the valve actuator assembly and the valve assembly and the number of parts required to complete the fuel injector 10 is reduced.

Once the valve actuator assembly 18 is mated with the valve assembly 16, an overmold 84 is formed to encase the valve assembly 16 and the valve actuator assembly 18. The overmold 84 maintains the relative orientation and position of the valve actuator assembly 18 to the valve assembly 16. As viewed in FIG. 1, the overmold 84 can also form an electrical harness connector portion 86 in which a portion of the electrical terminals 54 are exposed. The electrical terminals 54 and the electrical harness connector portion 86 can engage a mating connector, e.g., part of a vehicle wiring harness (not shown), to facilitate connecting the injector 10 to a supply of electrical power (not shown) for energizing the wire coil 58. In the preferred embodiment, the overmold is formed of injection molded plastic. The overmold 84 also provides a structural case for the injector and provides predetermined electrical and thermal insulating properties. Alternatively, the overmold 84 can be overmolded onto the valve actuator assembly 18 before the actuator assembly is secured to the valve assemebly 16. Then, the valve assembly 16 could be inserted into the pre-assembled valve actuator assembly 18 and overmold 84.

The second injector end 14 is to be in fluid communication with a fuel rail (not shown) to provide a supply of fuel. O-rings 32, 88 (FIG. 1) can be used to seal the second injector end 14 to the fuel rail (not shown), and to provide a fluid tight seal at the connection between the injector 10 and an internal combustion engine (not shown) at the first injector end 12.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A fuel injector for use with an internal combustion engine, the fuel injector comprising:

a tube assembly having a longitudinal axis and including:

a non-magnetic tube having a first end and a second end;

a pole piece disposed inside the non-magnetic tube intermediate the first and second ends;

an armature assembly disposed within the tube assembly between the pole piece and the first end, the armature assembly including an end face resiliently biased away from the pole piece;

a working air gap separating the end face and the pole piece when the end face is biased away from the pole piece;

a coil connectable to an electrical power source and operable to displace the end face toward the pole piece against the resilient bias on the armature assembly; and a housing positioned adjacent the working air gap and supporting the coil on the tube assembly, the housing extending around the coil and having a ferromagnetic inner wall extending between the coil and the non-magnetic tube, the ferromagnetic inner wall has an opening with a width that is substantially less than the length of the coil as measured parallel to the longitudinal axis.

2. The fuel injector according to claim 1, wherein the housing is centered about the working air gap along the longitudinal axis.

3. The fuel injector according to claim 1, wherein the pole piece has an annular wall;

the armature assembly further includes an ferromagnetic member with an annular wall;

the ferromagnetic inner wall is annular; and the non-magnetic tube has an annular wall that is substantially thinner than any one of the annular walls of the pole piece, the annular ferromagnetic member and the ferromagnetic inner wall.

4. The fuel injector according to claim 3, wherein the housing has a first end face, a second end face, and a center as measured along the longitudinal axis, the working air gap is located closer to the housing center than to the first and second end faces of the housing.

5. The fuel injector of claim 1, wherein the housing further includes:

first and second flanges extending away from the ferromagnetic inner wall; and an annular wall extending between the flanges, the annular wall includes: the ferromagnetic inner wall; and a non-magnetic protrusion extending into the opening; and a cylinder substantially surrounding the first and second flanges.

6. The fuel injector according to claim 5, wherein the ferromagnetic inner wall includes first and second ferromagnetic extensions directed toward each other and way from the first and second flanges, respectively.

7. The fuel injector according to claim 6, wherein the first and second ferromagnetic extensions extend substantially along longitudinal axis of the non-magnetic tube.

8. The fuel injector according to claim 7, wherein the longitudinal cross-sectional area of the ferromagnetic extensions is substantially greater than the longitudinal cross-sectional area of the non-magnetic tube adjacent the ferromagnetic extensions.

9. The fuel injector according to claim 7, wherein the non-magnetic tube includes an outer surface and the annular portions of the upper and lower bobbin portions engage the outer surface of the non-magnetic tube.

10. The fuel injector according to claim 9, wherein the coil generates a magnetic flux circuit when energized through the electrical power source, the magnetic flux circuit being external to the non-magnetic tube along the portion of non-magnetic tube engaged by the ferromagnetic extensions.

11. The fuel injector according to claim 7, wherein the coil generates a magnetic flux circuit when energized through the electrical power source, magnetic flux circuit travels along the ferromagnetic extensions.

12. The fuel injector according to claim 1, wherein the opening in the ferromagnetic inner wall is aligned with the working air gap along the longitudinal axis.

13. The fuel injector according to claim 12, wherein the opening is centered about the working air gap along the longitudinal axis.

14. The fuel injector according to claim 1, wherein the length of the non-magnetic tube equals the total length of the fuel injector as measured along the longitudinal axis.

15. The fuel injector according to claim 14, wherein the non-magnetic tube is homogenous.

16. The fuel injector of claim 1, wherein the housing further includes:

an annular sleeve; and a bobbin inserted in the annular sleeve, the bobbin including:

a first annular member having a radial flange and an axial extension; and a second annular member having a radial flange and an axial extension, the second annular member is concentric with the first annular member; and the axial projections extend toward each other and are separated by the opening.

17. The fuel injector of claim 16, wherein the bobbin further includes an annular casing containing the coil and connected between the radial flanges, the annular casing including an annular projection extending into the opening.

18. The fuel injector of claim 17, wherein the ferromagnetic inner wall includes the axial extensions; the radial flanges are ferromagnetic; and the annular projection is non-magnetic.

19. The fuel injector according to claim 17, wherein the annular projection is centered about the working air gap along the longitudinal axis.

20. A fuel injector for use with an internal combustion engine, the fuel injector comprising:

a tube having a first end, a second end and a longitudinal axis;

a pole piece disposed in the tube intermediate the first and second ends;

an armature disposed within the tube and spaced from the pole piece by a working air gap as measured in the longitudinal direction, the armature being adjustably biased away from the pole piece;

a sleeve;

a bobbin inserted in the sleeve and having a ferromagnetic portion engaging the outer surface of the tube on each side of the working air gap; and an electrical coil mounted on the bobbin, the electrical coil connectable to an electrical power source and operable to displace the armature relative to the pole piece and against the bias on the armature, the ferromagnetic portion being disposed between the tube and the electrical coil.

21. The fuel injector according to claim 20, wherein the tube comprises a thin-walled member.

22. A fuel injector for use with an internal combustion engine, the fuel injector comprising:

a tube having a first end, a second end and a longitudinal axis;

a pole piece disposed in the tube intermediate the first and second ends;

an armature disposed within the tube and spaced from the pole piece by a working air gap as measured in the longitudinal direction, the armature being adjustably biased away from the pole piece;

a sleeve;

a bobbin inserted in the sleeve and having a ferromagnetic portion engaging the outer surface of the tube on each side of the working air gap, the ferromagnetic portion including a first axial extension and a second axial extension spaced along the longitudinal axis from the first axial extension so as to define a space therebetween, the first and second axial extensions terminating proximate the working air gap; and an electrical coil mounted on the bobbin, the electrical coil connectable to an electrical power source and operable to displace the armature relative to the pole piece and against the bias on the armature.

23. The fuel injector according to claim 22, wherein the space between the first and second axially extending portions are centered on the working air gap.

24. The fuel injector according to claim 22, wherein the bobbin further includes first and second flanges connected to the first and second axial extensions, respectively, the first and second flanges are ferromagnetic.

25. The fuel injector according to claim 24, wherein the sleeve is ferromagnetic and the first and second flanges are connected to the sleeve.

26. The fuel injector according to claim 25, wherein the bobbin includes a non-magnetic intermediate portion in the space between the first and second axially extending portions.

27. The fuel injector according to claim 26, wherein the tube is formed from a non-magnetic material.

28. The fuel injector according to claim 27, wherein the thickness of one of the first and second axially extending portions is substantially greater than the thickness of the tube.

29. A method of assembling a fuel injector, comprises:

providing a tube assembly having a longitudinal axis and including:

a non-magnetic tube having a first end and a second end;

a pole piece disposed inside the non-magnetic tube intermediate the first and second ends;

providing an armature assembly disposed within the tube assembly between the pole piece and the first end, the armature assembly including an end face resiliently biased away from the pole piece;

separating the end face and the pole piece when the end face is biased away from the pole piece to create a working air gap;

providing a housing having a ferromagnetic inner wall, the ferromagnetic inner wall having an opening with a width that is substantially less than the length of the coil as measured parallel to the longitudinal axis;

placing in the housing a coil connectable to an electrical power source and operable to displace the end face toward the pole piece against the resilient bias on the armature assembly;

positioning the non-magnetic tube ferromagnetic inner wall between the coil and the non-magnetic tube;

positioning the housing adjacent the working air gap; and securing the housing to the tube assembly.

* * * * *